US008960147B2

(12) United States Patent
Yano

(10) Patent No.: US 8,960,147 B2
(45) Date of Patent: Feb. 24, 2015

(54) INTAKE MANIFOLD

(71) Applicant: Roki Co., Ltd., Hamamatsu-shi, Shizuoka (JP)

(72) Inventor: Kenji Yano, Hamamatsu (JP)

(73) Assignee: Roki Co., Ltd., Shizuoka (JP)

( * ) Notice: Subject to any disclaimer, the term of this patent is extended or adjusted under 35 U.S.C. 154(b) by 98 days.

(21) Appl. No.: 13/750,181

(22) Filed: Jan. 25, 2013

(65) Prior Publication Data

US 2013/0199486 A1 Aug. 8, 2013

(30) Foreign Application Priority Data

Feb. 7, 2012 (JP) ..... 2012-024192

(51) Int. Cl.
*F02M 35/10* (2006.01)

(52) U.S. Cl.
USPC ..... 123/184.24; 123/184.42

(58) Field of Classification Search
USPC ..... 123/184.24, 184.42, 184.34, 184.47
IPC ..... F02M 35/112,35/10026, 35/1036, F02M 35/10052, 35/10091
See application file for complete search history.

(56) References Cited

U.S. PATENT DOCUMENTS 7,556,007 B2 * 7/2009 Nicholas et al. ..... 123/184.21
8,037,859 B2 * 10/2011 Kameda ..... 123/184.38
2004/0261745 A1 * 12/2004 Kito et al. ..... 123/184.42
2006/0037575 A1 * 2/2006 Enokida et al. ..... 123/184.42
2009/0241886 A1 10/2009 Kameda
2012/0021179 A1 1/2012 Ohta et al.
2012/0291741 A1 * 11/2012 Ito et al. ..... 123/184.47
2013/0125851 A1 * 5/2013 Miyashita ..... 123/184.21

FOREIGN PATENT DOCUMENTS

JP 2007-107481 A 4/2007
JP 2011-132816 A 7/2011
WO 2008/007184 A2 1/2008

* cited by examiner

*Primary Examiner* — Marguerite McMahon
(74) *Attorney, Agent, or Firm* — Sughrue Mion, PLLC

(57) ABSTRACT

An intake manifold is provided with a chamber member provided with an exhaust port and a chamber formed therein, a port member provided with an intake groove forming a ventilation passage bent so as to be communicated with the exhaust port and the chamber of the chamber member when the chamber member and the port member are welded together, and a cover member that covers the port member from a side opposite to the welded side between the chamber member and the port member. The intake groove has an outer wall surface opposing to the chamber member is formed with a reinforcing member so as to protrude from at least one of the port member side or chamber member side toward another one thereof, and the reinforcing member extends along an extending direction of the intake groove, the reinforcing member is welded to another reinforcing member protruding from another outer wall surface of the port member and chamber member, or from the port member and the chamber member.

3 Claims, 5 Drawing Sheets

INTAKE MANIFOLD

BACKGROUND OF THE INVENTION

1. Field of the Invention

The present invention relates to an intake manifold, made of resin, adopted to introduce external air into an internal combustion engine.

2. Related Art

There is conventionally known an intake manifold made of resin and provided with a reinforcement rib. The reinforcement rib is for reinforcing a pipe of an intake pipe of the intake manifold. There is also known an intake manifold in which an intake pipe is provided with a boss for mounting another member. Concrete structures of such rib and boss having various shapes have been known for preventing the intake pipe from being damaged by load or like applied thereto.

For example, Patent Document 1 (Japanese Patent Laid-open Publication No. 2011-132816) discloses an intake manifold. This intake manifold is one in which the reinforcement rib extending along the axial direction and the boss for mounting another member are continuously formed to the intake pipe. Therefore, the intake pipe as well as the boss can be reinforced by the reinforcement rib together, thus preventing the intake pipe from being damaged by load applied to the boss for mounting another member.

According to the conventional intake manifold of the structure mentioned above, for example, the intake manifold disclosed in the Patent Document 1, although the intake pipe is reinforced by the reinforcement rib extending along the axial direction thereof, a port member and a chamber member are welded (fused) integrally together by means of vibration welding or like. Therefore, it is necessary to form respective members to have large thickness in terms of improvement in rigidity and insurance of fusing surface of the port member and the chamber member, which may result in difficulty in downsizing and light-weight of the intake manifold.

Furthermore, since the intake pipe is formed so as to provide bent (curved) shape, warpage of a weld (welding or welded) surface is corrected by applying a load to the vibration welding. However, since the correction of such warpage is made only by the weld surface, it becomes necessary to make large the weld surface in order to ensure the sealing performance and the reliability of the weld surface, thus being inconvenient.

SUMMARY OF THE INVENTION

The present invention was therefore conceived in consideration of the above circumstances and an object of the present invention is to provide an intake manifold capable of contributing downsizing and light weight of the intake manifold as well as improving sealing performance and reliability of the weld surface.

The above and other objects can be achieved according to the present invention by providing an intake manifold including: a chamber member provided with an exhaust port and a chamber formed therein; a port member provided with an intake groove forming a ventilation passage bent so as to be communicated with the exhaust port and the chamber of the chamber member when the chamber member and the port member are welded together; and a cover member that covers the port member from a side opposite to the welded side between the chamber member and the port member, wherein the intake groove has an outer wall surface opposing to the chamber member is formed with a reinforcing member so as to protrude from at least one of the port member side or chamber member side toward another one thereof, the reinforcing member extending along an extending direction of the intake groove, and the reinforcing member is welded to another reinforcing member protruding from another outer wall surface of the port member and chamber member, or from the port member and the chamber member.

In a preferred embodiment of the above aspect of the present invention, the following preferred modes may be provided.

The reinforcing member may be provided with an extending portion extending in a direction intersecting the extending direction.

The extending portion may be at least one extending portion.

It may be preferred that the extending portion includes extending portions formed at both end portions of the reinforcing member so as to provide an H-shaped section.

According to the intake manifold of the present invention, as described above, the intake groove of the port member has an outer wall surface opposing to the chamber member is formed with a reinforcing member so as to protrude from at least one of the port member side or chamber member side toward another one thereof, the reinforcing member extending along an extending direction of the intake groove, and the reinforcing member is welded to another reinforcing member protruding from another outer wall surface of the port member and chamber member, or from the port member and the chamber member.

Therefore, the welded (welding) strength can be improved by providing the reinforcing members, and hence, the port member and the chamber member can be made thin, which contributes to downsizing or light weight of the intake manifold.

The nature and further characteristic feature of the present invention will be further made clearer from the following descriptions made with reference to the accompanying drawings.

DESCRIPTION OF THE PREFERRED EMBODIMENT

Hereunder, a preferred embodiment of the present invention will be described with reference to the accompanying drawings. It is to be noted that the embodiment described hereinafter is not one defining the present invention of respective claims, and combination of characteristic features described herein is not always essential for the solution of the present invention, and it is further to be noted that terms "upper", "lower", "right", "left" and like terms indication direction are used herein on the illustrations of the drawings.

Figure 1:
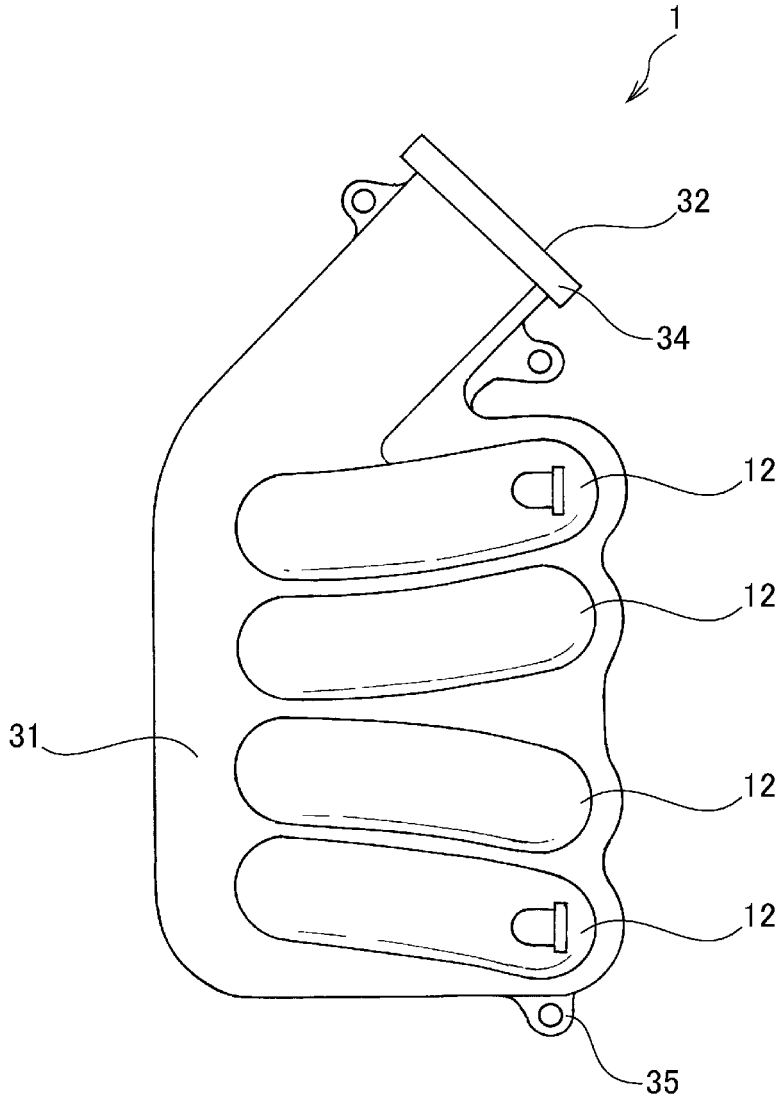
FIG. 1 is an illustration of a chamber member of an intake manifold according to the present embodiment for explaining a structure thereof.

With reference to FIG. 1, an intake manifold 1 according to the present embodiment is provided with a chamber member, explaining hereinafter, defining an inner space as a chamber 31, an intake port 32 through which an intake fluid is introduced into a chamber 31 of the chamber member and fluid passages 12 for distributing the introduced intake fluid to respective cylinders of an internal combustion engine.

The intake manifold 1 of the present embodiment is, for example, for an in-line four-cylinder internal combustion engine, and accordingly, four fluid passages 12 are formed to the chamber 31 of the chamber member. The intake port 32 is formed to a flanged portion 34 formed on an end portion of the chamber 31 of the chamber member, and the intake manifold 1 is mounted, through the flanged portion 34, to a throttle body, not shown, for controlling the intake fluid. In addition, a flange 35 is formed to an end portion of the fluid passage 12 opposing to one end continuous to the chamber 31. The flange 35 is for mounting to the internal combustion engine, not shown.

Hereunder, the structure or configuration of the intake manifold 1 according to the present embodiment will be explained with reference to FIG. 2.

Figure 2:
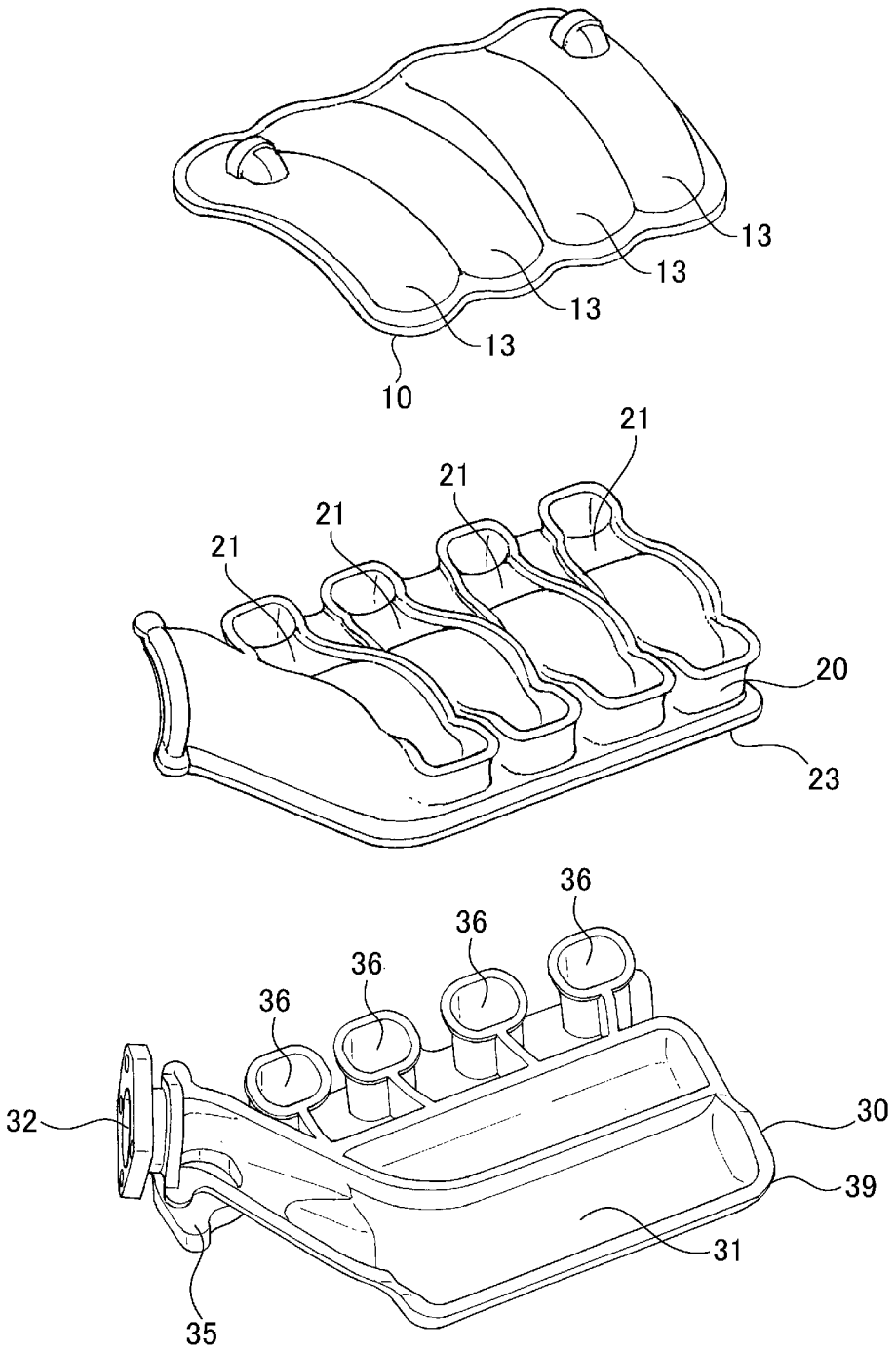
FIG. 2 is a developed perspective view of the intake manifold shown in FIG. 1 for explaining a structure of a chamber member thereof.

As shown in FIG. 2, the intake manifold 1 according to the present embodiment is generally composed of a port member 20 to which intake grooves 21 are formed, a port cover 10 for closing the intake groove 21 from the upper side thereof to thereby form the ventilation passages 12, and a chamber member 30 defining a space therein as the chamber 31 and formed with exhaust ports 36 adapted to introduce intake fluid into the internal combustion engine.

The port member 20 is arranged in a position interposed between the port cover 10 which is welded (or fused) to the port member 20 from the upper side thereof and the chamber member 30 which is welded (fused) to the port member 20 from the lower side thereof. That is, the port cover 10, the port member 20 and the chamber member 30 are welded in a stacked manner in this order from the upper side.

The port cover 10, the port member 20 and the chamber member 30 are formed of thermoplastic synthetic resin material such as polyamide group resin, polypropylene group resin or like resin material. These members 10, 20 and 30 are welded or fused together by causing friction heat by applying vibration to the weld surfaces between these members and then applying pressure thereto by means of pressure applying jig or sliding jig.

In addition, in the intake manifold 1 of the present embodiment, the welded portions of the port cover 10, the port member 20 and the chamber member 30 are stacked in an overlapped manner in the vertical direction on the exhaust port 36 side of the ventilation passage 12.

The port cover 10 is provided with closing portions 13 constituting an upper surface of the ventilation passage 12 by closing open end portions of the intake grooves 21. An outer peripheral edge portion of the port cover 10 is formed as a flanged weld surface to be welded with the port member 20.

The port member 20 is formed with the intake grooves 21 each curved (protruded) upward so as to be communicated with the exhaust ports 36 of the chamber member 30. Outer peripheral edge portions of the intake grooves 21 are formed as flanged weld surfaces to be welded with the port cover 10, and on the other hand, an outer peripheral edge portion of the lower end of the port member 20 is formed as a first weld surface to be welded with the chamber member 30.

The chamber member 30 is formed with the intake port 32 communicating with the inner space thereof formed as the chamber 31 and the exhaust ports 36 communicating with the ventilation passages 12. The exhaust ports 36 are formed so as to be continuous to the intake ports in the internal combustion engine, and the air taken through the intake port 32 is supplied to the internal combustion engine through the exhaust ports 36.

In the following, the welded surface between the port member 20 and the chamber member 30 of the intake manifold 1 of the present embodiment will be explained with reference to FIGS. 3 and 4.

Figure 3:
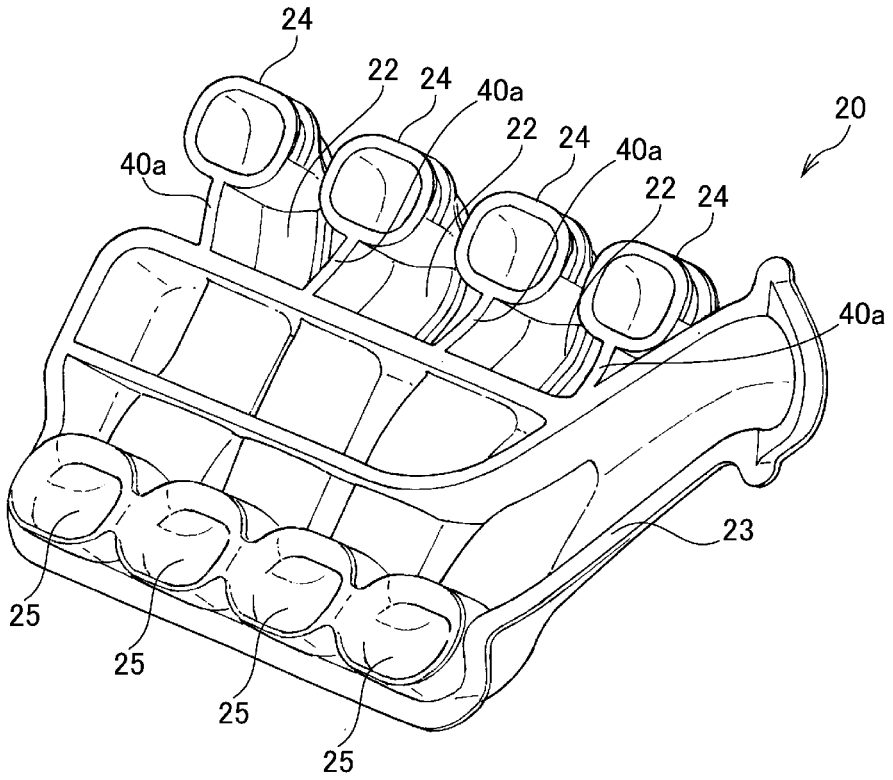
FIG. 3 is a perspective view of a port member of the intake manifold shown in FIG. 1 for explaining a structure of the port member.

As shown in FIG. 3, the first weld (welding or to be welded) surface 23 of the port member 20 is formed at substantially the same level as the second weld (welding or to be welded) surface 39 formed to the outer peripheral edge portion of the chamber 31 of the chamber member 30 so as to be welded with each other. Further, first reinforcing members 40*a* mounted to outer wall surfaces of the intake grooves 21 facing the chamber 31 of the chamber member 30 so as to protrude toward the chamber member 30 along the extending direction of the intake grooves 21, respectively.

Furthermore, each intake groove 21 has one end side connected to a pipe member 24 communicating with the exhaust port 36 of the chamber member 30, and also has another end side to which an introducing port 25 opened to the chamber 31 is formed. The introducing port 25 is formed into so-called funnel shape widened toward the opening end so as to smoothly introduce the intake fluid in the chamber 31.

Figure 4:
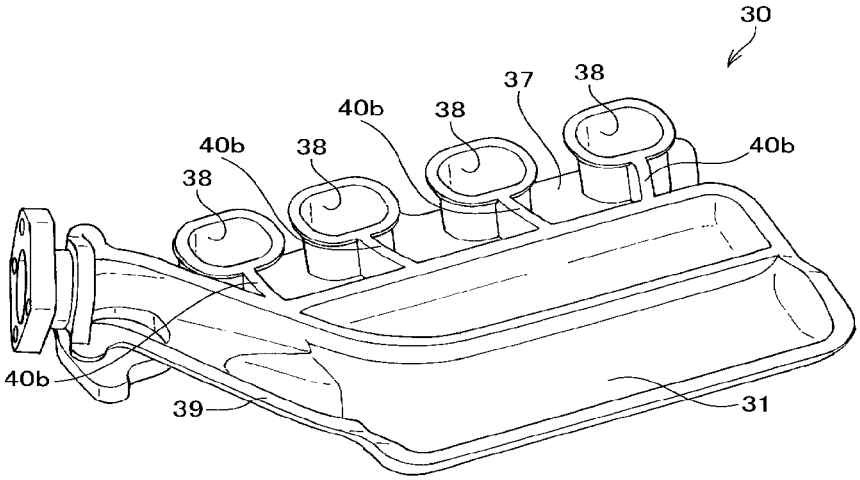
FIG. 4 is a perspective view of the chamber member of the intake manifold shown in FIG. 1 for explaining a structure of the chamber member.

As shown in FIG. 4, as mentioned above, the chamber member 30 is formed with the second fusing surface at the outer peripheral edge portion of the chamber 31. In addition, the chamber member 30 is formed with a plate member 37 so as to oppose to the outer wall portion 22 of the intake groove 21 of the port member 20. The exhaust port 36 and the pipe member 38 are formed to the plate member 37 so as to stand upward, and the pipe member 38 is formed so as to accord with the corresponding pipe member 24 formed to one end portion of the intake groove 21.

Furthermore, as also shown in FIG. 4, second reinforcing members 40*b* are formed to the plate member 37 so as to extend along the extending direction of the intake groove 21 to thereby connect the pipe members 38 and the second weld surface 39. When the port member 20 and the chamber member 30 are assembled (i.e., mated,) the second reinforcing members 40*b* abut against the first reinforcing members 40*a* of the chamber member 30 and then are welded together.

As mentioned above, when first weld surface 23 of the port member 20 and the second weld surface 39 of the chamber member 30 are mated and welded together, the chamber 31 is defined in the chamber member 30, and at the same time, the first reinforcing members 40*a* and the second reinforcing members 40*b* are also welded together, the welded (welding) strength between the port member 20 and the chamber member 30 can be improved.

In the forgoing, although the intake manifold 1 of the present embodiment is explained with reference to the example in which the first and second reinforcing members 40*a* and 40*b* extend along the extending direction of the intake grooves 21, the reinforcing members may be formed by additionally providing an extending portion 41 in a direction intersecting the extending direction of the first and second reinforcing members.

Figure 5:
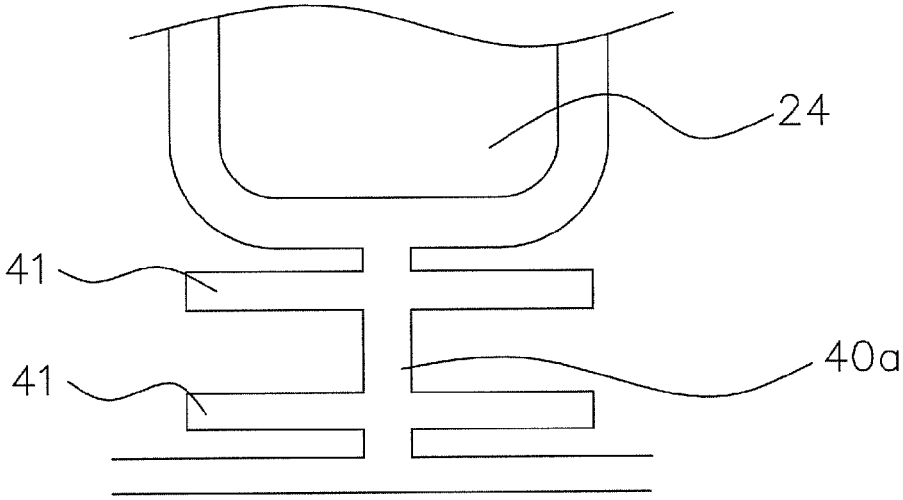
FIG. 5 is an illustration, in an enlarged scale, showing a first modification (modified example) of a reinforcing portion of the intake manifold according to the present embodiment.
Figure 6:
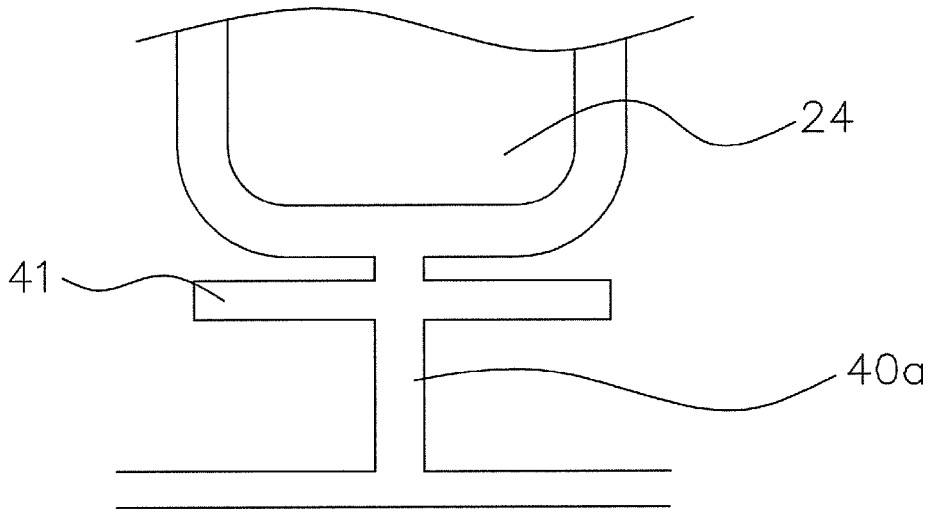
FIG. 6 is an illustration, in an enlarged scale, showing a second modification (modified example) of a reinforcing portion of the intake manifold according to the present embodiment.
Figure 7:
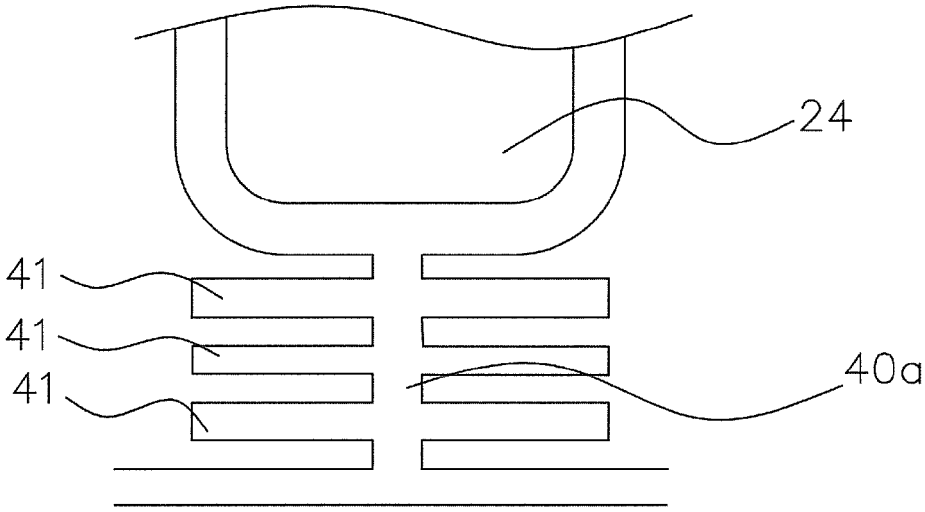
FIG. 7 is an illustration, in an enlarged scale, showing a third modification (modified example) of a reinforcing portion of the intake manifold according to the present embodiment.

FIGS. 5 to 7 represent modified embodiments of reinforcing members of the intake manifold 1 according to the present embodiment. That is, as shown in FIGS. 5 to 7, the first and second reinforcing members 40*a* and 40*b* are provided with the extending portions 41 in the direction intersecting the extending direction of the first and second reinforcing members 40*a* and 40*b*.

The number of the extending portions 41 to be formed may be changed optionally in accordance with desired welding strength, and such extending portions 41 may be arranged so as to provide T-shape, H-shape, or 王-shape as shown in FIGS. 5, 6 and 7, respectively.

As mentioned hereinbefore, in the structure of the intake manifold of the present embodiment, since the reinforcing members are provided in an inner space of the ventilation passage which has not effectively been utilized as a dead space in a conventional structure of an intake manifold, the welded strength of the port member 20 and the chamber member 30 can be improved and ensured, which may result in contribution for making thin the thickness of the port member 20 and the chamber member 30 realizing light weight and compactness of the intake manifold, thus being advantageous.

Furthermore, in the described embodiment of the intake manifold 1, the first reinforcing members 40*a* and the second reinforcing members 40*b* are formed in the manner protruding oppositely to each other from the port member 20 and the chamber member 30. However, in an alternated embodiment, it may be possible to form the first reinforcing members to either one of the port member 20 and the chamber member 30, and for example, the first reinforcing members 40*a* may be formed toward the chamber member 30 from the outer wall surface 22, opposing to the chamber member 30, of the intake grooves 21 of the port member 20 so as to abut against the plate member 37 or like member of the chamber member 30 and are then welded thereto.

Still furthermore, in the forgoing description, although there is explained the intake manifold 1 applicable to the in-line four-cylinder internal combustion engines, the intake manifold of the present embedment may also applicable to any other internal combustion engine. For example, if being applied to an in-line six-cylinder internal combustion engine, six ventilation passages may be formed. That is, the shape and the number of the ventilation passage may be optionally changed in accordance with an internal combustion engine to which the intake manifold of the present embodiment is applied.

That is, as mentioned above, it is to be noted that the present invention is not limited to the described embodiment and many other changes and modifications or alternations may be made without departing from the spirits and scopes of the appended claims.

What is claimed is:

1. An intake manifold comprising:

a chamber member provided with an exhaust port and a chamber formed therein;

a port member provided with an intake groove forming a ventilation passage bent so as to be communicated with the exhaust port and the chamber of the chamber member when the chamber member and the port member are welded together; and a cover member that covers the port member from a side opposite to the welded side between the chamber member and the port member, wherein the intake groove comprises a first outer wall surface facing the chamber member, the first outer wall surface comprising a first reinforcing member protruding from the first outer wall surface toward the chamber member, the first reinforcing member extending along an extending direction of the intake groove, and wherein chamber member comprises a second outer wall surface facing the port member, the second outer wall surface comprising a second reinforcing member protruding from the second outer wall surface and welded to the first reinforcing member, wherein the first and second reinforcing members comprise an extending portion extending in a direction intersecting the extending direction.

2. The intake manifold according to claim 1, wherein the extending portion is at least one extending portion.

3. The intake manifold according to claim 2, wherein the extending portion includes extending portions formed at both end portions of the reinforcing member so as to provide an H-shaped section.

* * * * *